United States Patent [19]

Dickson

[11] Patent Number: 4,563,890

[45] Date of Patent: Jan. 14, 1986

[54] CUT-OFF STYLE, ROLL THREAD FLAT DIES

[75] Inventor: Joseph F. Dickson, Boylston, Mass.

[73] Assignee: Litton Industrial Products, Inc., Holden, Mass.

[21] Appl. No.: 574,411

[22] Filed: Jan. 27, 1984

[51] Int. Cl.[4] ..... B21H 3/06

[52] U.S. Cl. ..... 72/469; 72/71; 72/88

[58] Field of Search ..... 72/469, 88, 90; 10/4, 10/9, 21, 31

[56] References Cited

U.S. PATENT DOCUMENTS

| | | | |
|---|---|---|---|
| Re. 26,518 | 1/1969 | Mau et al. | 72/469 |
| 319,756 | 6/1885 | Simonds | 72/469 |
| 352,365 | 11/1886 | Simonds | 72/469 |
| 1,961,257 | 6/1934 | Thomson | 72/469 |
| 3,789,643 | 2/1974 | Dickson | 72/469 |
| 3,889,516 | 6/1975 | Yankee et al. | 72/469 |

FOREIGN PATENT DOCUMENTS

| | | | |
|---|---|---|---|
| 1470783 | 4/1977 | United Kingdom | 72/90 |

*Primary Examiner*—Daniel C. Crane

[57] ABSTRACT

A cut-off style, roll thread flat die for use with a matched cut-off style, roll thread flat die to form a threaded, pointed fastener such as a gimlet point screw, the cut-off style, roll thread flat die having a top operating surface comprising body-threads, point threads, a slug traction ramp to provide controlled rotation for the cut-off slug and a slug extrusion taper to provide proper extrusion of the cut-off slug from the fastener, the slug traction ramp and the slug extrusion taper extending in side-by-side relation from a start location, past a transition location to a termination location, the slug traction ramp and the slug extrusion taper having a common edge and thereby being laterally continuous from the start location to the transition location, the slug extrusion taper forming an obtuse angle with the slug traction ramp from the start location to the transition location, the edge of the slug extrusion taper adjacent the slug traction ramp being substantially vertically spaced above the edge of the slug traction ramp adjacent the slug extrusion taper from the transition location to the termination location, the spacing continuously increasing from the transition location to the termination location, the slug extrusion taper having a selected and constant angle of inclination, and the slug traction ramp having a selected and constant orientation.

7 Claims, 6 Drawing Figures

CUT-OFF STYLE, ROLL THREAD FLAT DIES

The present invention relates to cut-off style, roll thread flat dies which are used to produce gimlet point screws and the like. State of the art cut-off style, roll thread flat dies are disclosed in U.S. Pat. No. 3,789,643, which names Joseph F. Dickson (the inventor herein) as the sole inventor and in U.S. Pat. No. 3,405,545 (Both are manufactured by the assignee of this application.).

It is an object of the present invention to provide a cut-off style, roll thread flat die which will improve the quality of the formed fastener.

An advantage of the present invention is the achievement of a substantial improvement in the noise level attendant the use of these dies.

Other objects and advantages of the present invention will become apparent from the following portion of the specification and from the accompanying drawings which illustrate, in accordance with the mandate of the patent statutes, a presently preferred embodiment incorporating the principles of the invention.

Referring to the drawings:

FIG. 2 is a simplified oblique view of a portion of the die illustrated in FIG. 1 showing five vertical slices taken at a—a, b—b, c—c, d—d and e—e of FIG. 1 with the outer contours of the die being drawing in;

Figure 1:
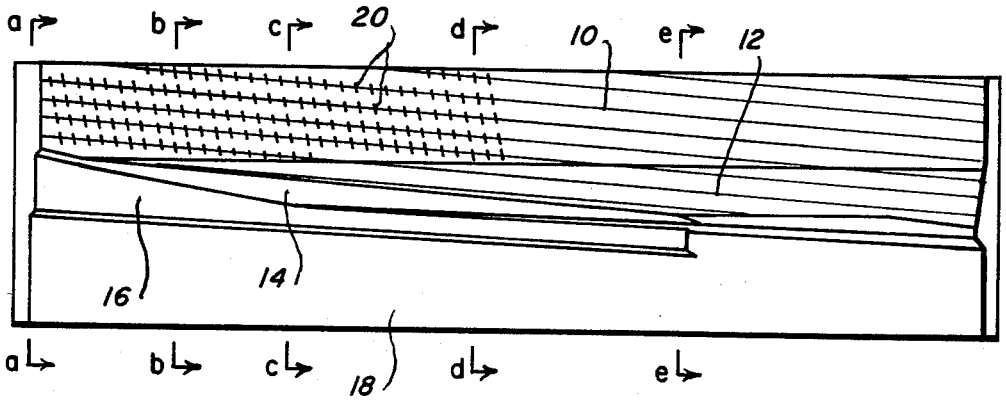
FIG. 1 is a top view of a cut-off style, roll thread flat die made in accordance with the teachings of the present invention.

The stationary die of a pair of matched cut-off style, roll thread flat dies is illustrated in FIG. 1. A stationary cut-off die (with its matched movable die-not shown) operates on a cylindrical blank to form a pointed threaded object, such as a gimlet point screw, and produces an extruded pointed slug in the process. The top or operating face of the die includes body threads 10, point threads 12, a slug extrusion taper 14 to form the pointed end, a slug traction ramp 16 to provide controlled rotation of the cut-off slug and a slug relief area 18. The body threads 10 and the point threads 12 are conventional, and the body threads may be cross-nicked 20 as shown.

Figure 2:
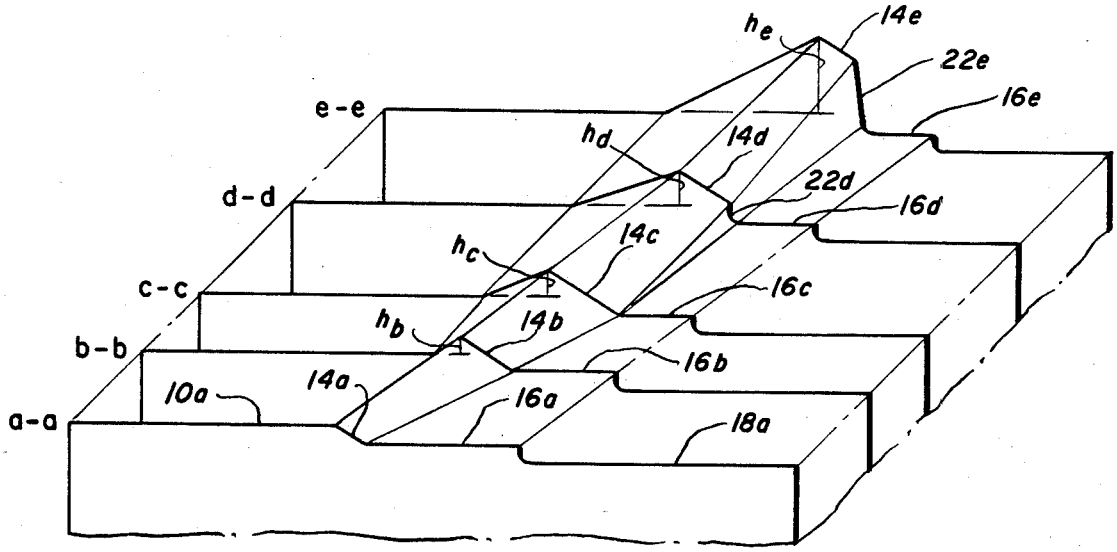

The nature of and relationship between the slug extrusion taper and the slug traction ramp are illustrated in FIG. 2, which is a simplified oblique view of a portion of the die shown in FIG. 1. Five discrete vertical "slices" taken at a—a, b—b, c—c, d—d, and e—e of FIG. 1 are shown in this sketch. The first or fowardmost vertical "slice" of the die shown in FIG. 2 was taken at the start location (a—a) of the die illustrated in FIG. 1. As can be seen from this slice, the horizontal slug traction ramp 16*a* is located below the crest of the body threads (represented by horizontal line 10*a*) and above the slug relief area 18*a*. This ramp 16*a* is laterally continuous with the slug extrusion taper 14*a* which defines a selected angle with the horizontal and which extends from the slug traction ramp 16*a* to the height of the crest of the body threads (10*a*). The angle of the slug extrusion taper 14*a*, 14*b*, 14*c*, 14*d*, 14*e* remains the same throughout its length as does the horizontal orientation of the slug traction ramp 16*a*, 16*b*, 16*c*, 16*d*, 16*e*.

In the second slice (b—b), the slug extrusion taper 14*b* and the slug traction ramp 16*b* continue to be laterally continuous. The slug extrusion taper 14*b* extends above the crest of the body threads 10*b* by a selected distance $h_b$ forming a peak. The length of the slug extrusion taper 14*b* has also increased from its length 14*a* at the start location.

The third slice (c—c) shows the further lengthening of the slug extrusion taper 14*c* and its further increased height $h_c$, which can be seen by the increased size of the peak. From the start location (a—a) to this transition location (c—c), the slug extrusion taper 14 and the slug traction ramp 16 have a common edge and are accordingly laterally continuous. While the slug traction ramp 16 progressively decreases in width proceeding from the start location 16*a* to the transition location 16*d*, it remains constant in width from the transition location to the termination location 16*e*.

From the transition location (c—c) to the termination location (e—e), the slug extrusion taper 14 and the slug traction ramp 16 are laterally discontinuous being connected by a slightly inclined step 22. The length of this step, which is zero at the transition location (c—c), continuously increases proceeding through location d—d to the termination location (e—e).

The vertical height of the slug extrusion taper $h_b$, $h_c$, $h_d$, $h_e$ continues to increase to a maximum at the termination location (e—e) and the lateral width of the slug extrusion taper 14*c*, 14*d*, 14*e* continuously decreases from the transition location to the termination location (e—e).

To enhance the traction of the slug, the entirety of the slug extrusion taper 14 and the slug traction ramp 16 may be roughened. In the embodiment illustrated in FIG. 3, these surfaces have a continuously roughened character as a consequence of electric discharge machining (EDM). Surface roughness exceeds about 300 micro-inches.

Figure 3:
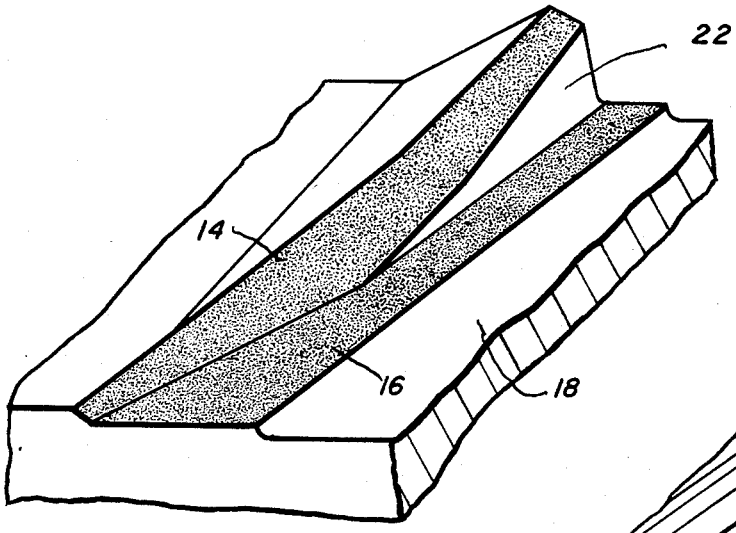
FIG. 3 is a view of a portion of FIG. 2 showing the slug extrusion taper and the slug traction ramp with continuously roughened surfaces.
Figure 4:
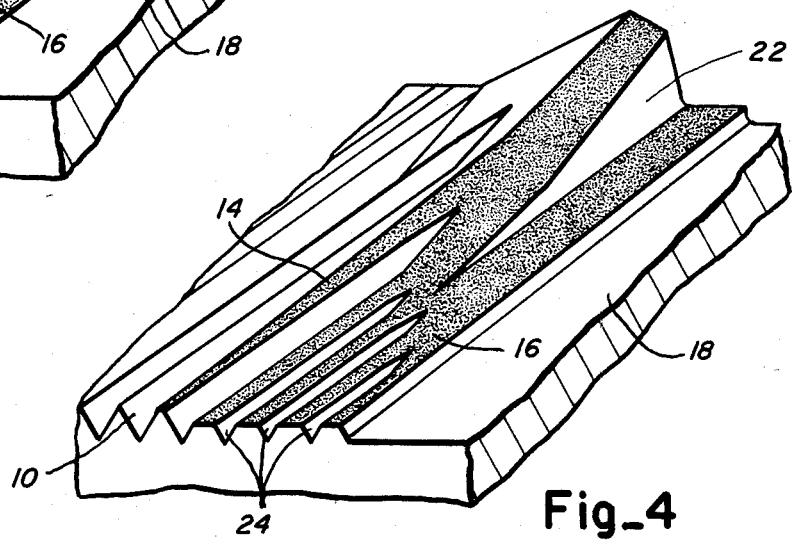
FIG. 4 is a view similar to that of FIG. 3 showing a modification thereof.

FIG. 4 shows a variation of FIG. 3 with threads 24 (the same configuration and height as the body threads 10) being cut into the slug extrusion taper 14 and slug traction ramp 16 from the start location (a—a) toward the transition location (c—c) with the threads 24 in the slug extrusion taper extending beyond the transition location.

Figure 5:
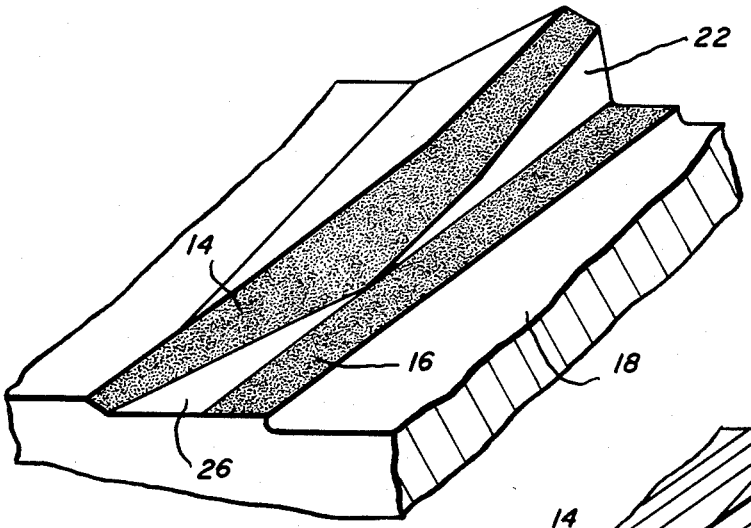
FIG. 5 is a view similar to that of FIG. 3 showing another variation thereof.
Figure 6:
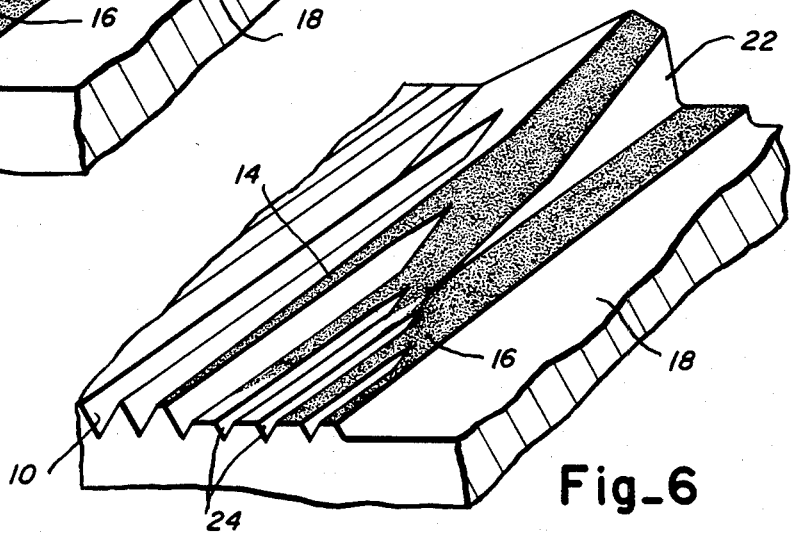
FIG. 6 is a view similar to that of FIG. 5 showing a modification thereof.

Another variation of FIG. 3 is shown in FIG. 5 where the portion of the slug traction ramp continuously roughened has constant width and direction (the width and direction of the slug traction ramp from the transition location to the termination location). In this variation, a triangular portion 26 of the slug traction ramp is not machined by an EDM process, and accordingly, has a height slightly above (approximately one and one half thousands) the portion which has been roughened. The slug extrusion taper and the slug transition ramp may additionally be threaded 24 (FIG. 6) in the manner previously illustrated in FIG. 4.

What is claimed is:

1. A cut-off style, roll thread flat die for use with a matched cut-off style, roll thread flat die to form a threaded, pointed fastener such as a gimlet point screw, said cut-off style, roll thread flat die having a top operating surface extending horizontally comprising means to form body-threads and point threads in said fastener, a slug traction ramp to provide controlled rotation for the cut-off slug and a slug extrusion taper to provide proper extrusion of the cut-off slug from the fastener, said slug traction ramp and said slug extrusion taper extending in side-by-side relation from a start location, past a transition location to a termination location, said slug traction ramp and said slug extrusion taper having a common edge and thereby being laterally continuous from said start location to said transition location, said slug extrusion taper forming an obtuse angle with said slug traction ramp from said start location to said transition location, the edge of said slug extrusion taper adjacent said slug traction ramp being substantially vertically spaced above the edge of said slug traction ramp adjacent said slug extrusion taper from said transition location to said termination location, said spacing continuously increasing from said transition location to said termination location, said slug extrusion taper having a selected and constant angle of inclination, said slug traction ramp having a selected and constant orientation, and said slug traction ramp and extrusion taper being oriented relative to each other so that the cut-off slug is controllably rotated by the slug traction ramp as the fastener is threaded and the slug cut from the fastener body.

2. A cut-off style, roll thread flat die according to claim 1, wherein said slug traction ramp and said slug extrusion taper have a roughened surface.

3. A cut-off style, roll thread flat die according to claim 2, wherein said roughened surfaces of said slug extrusion taper and said slug traction ramp are continuously roughened to at least a continuous roughness of about 300 micro-inches.

4. A cut-off style, roll thread flat die according to claim 3, further comprising threads defined in said slug traction ramp from said start location toward said transition location.

5. A cut-off style, roll thread flat die according to claim 1, wherein said slug traction ramp has a constant width, constant direction portion and the surface of said slug extrusion taper and the surface of said constant width, constant direction portion of said slug traction ramp extending from said start location to said termination location are roughened.

6. A cut-off style, roll thread flat die according to claim 5, wherein said roughened surfaces of said slug traction ramp and slug extrusion taper are continuously roughened to at least a continuous roughness of about 300 micro-inches.

7. A cut-off style, roll thread flat die according to claim 6, wherein said slug traction ramp has a second portion between said slug extrusion taper and said constant width, constant direction portion of said slug traction ramp from said start location to said transition location, and further comprising threads defined in said constant width, constant direction portion and in said second portion of said slug traction ramp from said start location toward said transition location.

* * * * *